United States Patent [19]

Vernay

[11] Patent Number: 4,690,196

[45] Date of Patent: Sep. 1, 1987

[54] CASTING OF MOLTEN FERROUS METAL AND MOULDS FOR USE THEREIN

[75] Inventor: Pierre Vernay, Milly la Foret, France

[73] Assignee: Foseco International Limited, Birmingham, England

[21] Appl. No.: 16,005

[22] Filed: Feb. 18, 1987

[30] Foreign Application Priority Data

Feb. 25, 1986 [GB] United Kingdom ..... 8604569

[51] Int. Cl.[4] ..... B22D 27/00

[52] U.S. Cl. ..... 164/58.1; 164/349; 164/358

[58] Field of Search ..... 164/55.1, 56.1, 57.1, 164/58.1, 349, 358

[56] References Cited

U.S. PATENT DOCUMENTS 4,210,195 7/1980 Mepherson ..... 164/58.1

FOREIGN PATENT DOCUMENTS

G8437376.8 3/1985 Fed. Rep. of Germany .
1448058 9/1976 United Kingdom .
1492692 11/1977 United Kingdom .
2072553A 10/1981 United Kingdom .

OTHER PUBLICATIONS

"Use of Filter Materials in Gating Systems" by T. J. Casteledine–Foundry Trade Journal, Jan. 17, 1985.
"Filtration of Irons with Cellular Ceramic Filters", by P. Day and H. Kind–Modern Casting, Apr., 1984.

*Primary Examiner*—Kuang Y. Lin
*Attorney, Agent, or Firm*—Nixon & Vanderhye

[57] ABSTRACT

A mould for use in the casting of molten ferrous metal is described comprising a mould cavity and a runner system comprising a sprue, a sprue well and a runner, and having located in the runner a ceramic filter having an open-cell foam structure. A sealed plastics container containing particles of a treatment agent, such as an inoculant for the molten ferrous metal is located in a chamber in the runner system on that side of the filter which is further from the mould cavity such that part of the container is in the sprue well.

14 Claims, 2 Drawing Figures

CASTING OF MOLTEN FERROUS METAL AND MOULDS FOR USE THEREIN

Figure 1:
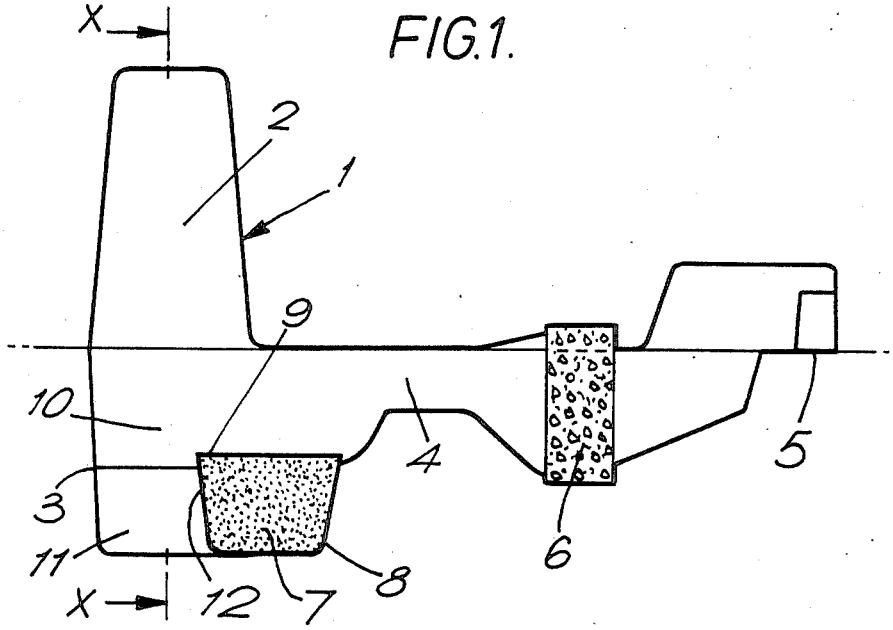

This invention relates to the casting of molten ferrous metal in a mould, and to a mould for use therein.

When molten ferrous metal is treated with a treatment agent prior to casting there is a tendency for the effect of the agent to be diminished, (known as "fading"), before the metal is cast into moulds. Various methods have therefore been proposed for treating molten iron as late as possible in the casting process, either by treating the iron just before it enters the mould or by treating the iron in the mould itself.

Treatment in the mould involves placing the treatment agent at a point in the runner system, preferably as near to the mould cavity as possible, so that the molten iron is treated as it flows through the runner system.

Attempts have been made to utilise treatment agents in the form of fine particles, for example fine particles of ferrosilicon for inoculating grey cast iron or spheroidal graphite iron, but they have not been successful because the particles of treatment agent tend to get washed into the mould cavity where they can form inclusions in the casting produced when the molten iron solidifies, and because there is a tendency for castings having variations in their microstructure to be produced.

In order to overcome the problems associated with the use of fine particles methods have been proposed which utilise inserts made of bonded, compressed or sintered particulate treatment agents, over which or through which the molten iron flows, and in one such method the insert rests on a strainer core. However none of these methods has been wholly successful and none has achieved wide commercial use. Cast inserts have also been used but because they tend to shatter under the influence of thermal shock they can give rise to inclusions in the castings.

It has now been found that molten metal can be treated in a mould with a particulate treatment agent by using in combination a particulate treatment agent in a sealed plastics container and a ceramic filter having an open cell foam structure.

According to the invention there is provided a process for casting molten ferrous metal in a mould in which molten ferrous metal is poured into a mould comprising a mould cavity and a runner system comprising a sprue, a sprue well and a runner, and having located in the runner a ceramic filter having an open-cell foam structure, characterised in that a sealed plastics container containing particles of a treatment agent for the molten ferrous metal is located in a chamber in the runner system on that side of the filter which is further from the mould cavity such that part of the container is in the sprue well, and the molten ferrous metal is treated by the treatment agent before flowing through the filter and into the mould cavity.

According to a further feature of the invention there is provided a mould for casting molten ferrous metal comprising a mould cavity and a runner system comprising a sprue, a sprue well and a runner, and having located in the runner a ceramic filter having an open-cell foam structure, characterised in that a sealed plastics container containing particles of a treatment agent for the molten ferrous metal is located in a chamber in the runner system on that side of the filter which is further from the mould cavity such that part of the container is in the sprue well.

Preferably the container is located in the chamber such that its top surface is above the top of the cavity and preferably at least part of a lateral surface of the container and the adjacent part of the top surface of the container are in the sprue well.

In a particularly preferred embodiment of the invention the sprue well has an upper part and a lower part, the dimensions of the lower part transverse to the horizontal axis of the runner are smaller than those of the upper part and, only the central part of the lateral surface of the container below the height of the chamber is in contact with the lower part of the sprue well.

The whole of the top surface of the container should not be in the sprue well otherwise disintegration of the plastics container and dissolution of the treatment agent will not take place in a satisfactory manner. Preferably the area of the surface adjoining the top of the lateral surface of the container in the sprue well does not exceed 50% of the total area of that surface.

In order to obtain optimum results it is also preferred that at least part of the runner between the ceramic filter and the container has a cross-sectional area which is equal to the smallest horizontal cross-sectional area of the sprue.

Open-cell ceramic foams which are suitable for use as filters for molten ferrous metals may conveniently be made by impregnating an organic foam, such as reticulated polyurethane foam, with an aqueous slurry of ceramic material containing a binder, drying the impregnated foam to remove water, and then firing the dried impregnated foam to burn off the organic foam to produce a ceramic foam replica. The production of ceramic foams by such a method is described in U.S. Pat. No. 3090094, in British Pat. Nos. 923862, 916784, 1004352, 1054421, 1377691, 1388911, 1388912 and 1388913 and in European Patent Application Publication No. 0074978.

The material used for the ceramic foam filter must withstand the temperature of and be resistant to molten ferrous materials and suitable materials include alumina, high alumina content silicates such as sillimanite, mullite and burned fireclay, silicon carbide and mixtures thereof. The binder used must produce a bond which is also capable of withstanding the temperature of and is resistant to the molten ferrous metal and examples of suitable binders include monoaluminium phosphate and monochromium phosphate. The preferred ceramic foam filters have compositions and physical properties as described in European Patent Application Publication No. 0074978.

The treatment agent used may be for example an agent for inoculating grey cast iron or spheroidal graphite iron, an agent for converting graphite in molten iron to nodular or spheroidal form, an agent for converting graphite in molten iron to vermicular form, an agent for introducing alloying elements into the molten iron, or an agent for performing some other treatment process.

Examples of suitable treatment agents for inoculating iron are ferrosilicon, usually containing 50–85% by weight of silicon and small quanitities of calcium and/or aluminium, and calcium silicide. Special types of ferrosilicon containing other elements such as titanium, chromium, zirconium, manganese, alkaline earths, e.g. barium or strontium, or rare earths, e.g. cerium, may also be used.

Examples of treatment agents for producing spheroidal graphite or nodular iron include grades of ferrosilicon containing small quantities of elements such as magnesium alone or magnesium and calcium, and suitable treatment agents for producing vermicular graphite include 5% magnesium ferrosilicon containing cerium used in combination with ferrotitanium or titanium metal, and magnesium-titanium-rare earth metal alloys.

Treatment agents which can be used for making alloying additions include for example ferrochromium, ferromolybdenum or ferrotitanium, and other treatment agents which can be used include, for example elements such as bismuth and tellurium.

The size of the particles of treatment agent may be up to about 10 mm but preferably particles having a narrow size range of less than 6 mm, more preferably 0.5 mm–2 mm, are used. Relatively large particles tend to produce slower fading because they dissolve relatively slowly but they may produce insufficient nucleation centres. Relatively small particles produce sufficient nucleation centres and therefore improve the mechanical properties of the cast metal, but because they dissolve faster they tend to produce more rapid fading.

Suitable plastics for forming the container for the particulate treatment agent include polystyrene, polypropylene, acrylonitrile-butadiene-styrene polymers, polyamides, polyethylene and ethylene-vinyl alcohol polymers. Polystyrene is preferred.

The container may be made from a single layer or film of plastics material or from two or more layers or films of the same or different plastics material. For example the container may be made from polystyrene film or as a three layer structure from polystyrene film as the base layer, ethylene-vinyl alcohol as the intermediate layer to ensure that the container is impermeable to air, and polyethylene as the top layer to enable the container to be sealed by the application of heat and to weld the container to a cover or lid.

The cover or lid may also be made of one or more plastics materials such as those materials listed above, and the plastics material may be the same or different from the plastics material from which the container is formed. If desired a cover or lid made from paper or from a metal such as aluminium may also be used.

The wall thickness of the container and the thickness of the cover or lid may be for example from 0.1 to 2 mm.

For convenience the preferred shape of the sealed container is a parrallelepiped but other shapes such as cylindrical may be used.

The sealed container containing the particulate treatment agent may be made, for example, by the following method:

Plastics film, for example polystyrene film, is heated and deformed to the desired shape of the container using a suitably shaped tool and the application of positive pressure or vacuum. The container is then filled with a predetermined amount, e.g. by weight or volume, of particulate treatment agent, and the container is vibrated to ensure adequate filling and to compact the treatment agent particles. A cover of plastics film is then placed on top of the container so as to enclose the particulate treatment agent, and the cover is sealed to the top edge of the container under vacuum or a neutral gas such as nitrogen. Such a method is readily adaptable for use as a continuous manufacturing process using as starting materials for both the container and the cover rolls of plastics film.

If desired the container may be filled with the particulate treatment agent under vacuum in order to protect the particles from oxidation and/or to cause the molten ferrous metal to be sucked around the particles during use.

The sealed containers are convenient to use because they can simply be placed, either manually or automatically by means of a robot, in chambers of appropriate size moulded into mould runner systems, and the required additions of treatment agent can be made more accurately and more consistently than when using loose particulate treatment agents.

Figure 2:
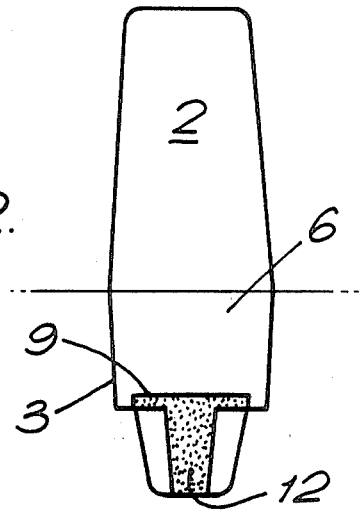

The invention is illustrated with reference to the accompanying drawings in which:

FIG. 1 is a schematic vertical longitudinal section through a mould according to the invention and FIG. 2 is a schematic transverse section along the line X—X of FIG. 1.

The sand forming the mould is not shown.

Referring to the drawings a mould 1 comprising a mould cavity (not shown) and a runner system comprising a sprue 2, a sprue well 3 and a runner 4 has an ingate 5 communicating with the mould cavity and a ceramic filter 6 having an open-cell foam structure located in the runner 4. A sealed plastics container 7 is located in a chamber 8 in the runner system on that side of the filter 6 which is further from the mould cavity such that part of the container 7 is in the sprue well 3. The top surface 9 of the container 7 is above the top of the chamber 8. The sprue well 3 has an upper part 10 and a lower part 11 and the transverse dimensions of the lower part 11 are smaller than those of the upper part 10. The central part of the lateral surface 12 of the container 7 below the height of the chamber 8 is in contact with the lower part 11 of the sprue well 3 and the lateral surface 12 of the container 7 above the height of the chamber 8 and part of the top surface 9 of the container are in contact with the upper part 10 of the sprue well 3.

When molten ferrous metal is poured into the mould 1 disintegration of the plastics forming the container commences at the central part of the lateral surface 12 and at the adjacent part of the top surface 9 and the molten ferrous metal comes into contact with the treatment agent in the container 7. Treated molten ferrous metal then flows through the runner 4, the ceramic filter 6 and the ingate 5 into the mould cavity.

A series of tests was carried out using moulds as shown in the drawing for the production of crankshaft castings in spheroidal graphite iron. Open-cell ceramic foam filters of silicon carbide, aluminium and silica, and bonded by aluminium orthophosphate and sealed parallelpiped polystyrene containers, containing in some instances 80 g and in some instances 40 g of an inoculant for spheroidal graphite iron were used. The inoculant contained, by weight, 65% silicon, 3.8% zirconium, 1.4% calcium, 1.4% aluminium, 4% manganese and 24.4% iron.

For comparison purposes a similar mould was also produced in which the container containing the inoculant was not located in the runner system in the manner according to the invention and another mould was produced in which the inoculant was an ingot of ferrosilicon instead of a particulate material contained in a sealed plastics container.

Molten spheroidal graphite iron which had been inoculated in a ladle with 0.40% by weight based on the weight of iron of a strontium-containing ferrosilicon, and containing nominally 3.8% carbon, 2.0% silicon, 0.7% manganese,0.05% magnesium and 0.01% sulphur was poured into each of the moulds at a temperature of 1430° C. so that the iron was inoculated by the inoculant in the sealed plastics container before flowing through the filter into the mould cavity.

The silicon content, metallographic structure and graphite nodule density were determined at the heavy section and light section ends, and in some cases at the medium section in the middle of the castings.

Further details of each of the tests and the results obtained are tabulated below.

All the castings which had been produced using a process and mould according to the invention were superior in terms of nodule count (nodules per $mm^2$), which is a measure of inoculation efficiency, to the casting produced using an inoculant in a container located in line with the bottom of the runner and with its edge tangential to the sprue. The castings produced using 80 g of 0–2 mm particle size inoculant or 40 g of 0.5–2 mm particle size inoculant were comparable in terms of nodule count to the casting produced using a 90 g ferrosilicon ingot, and the castings produced using 80 g of 0.5–2 mm particle size inoculant were superior in terms of nodule count to the casting produced using the 90 g ferrosilicon ingot. All the test castings showed a consistent distribution of silicon.

| INOCULANT | LOCATION OF CONTAINER | % PEARLITE | % FERRITE | NODULES PER SQ. mm | % SILICON | CASTING SECTION |
|---|---|---|---|---|---|---|
| FERROSILICON | — | 70 | 30 | 137 | 1.94 | HEAVY END |
| INGOT | | 70 | 30 | 107 | 1.94 | MIDDLE |
| 90 g | | — | — | 270 | 1.87 | LIGHT END |
| 80 g | Top of container | | | 70 | 2.03 | HEAVY END |
| PARTICLES | in line with | | | 160 | 2.02 | LIGHT END |
| 0–2 mm | bottom of runner and edge tangential to sprue | | | | | |
| 80 g | As in | 70 | 30 | 123 | 1.91 | HEAVY END |
| PARTICLES | Drawings | 70 | 30 | 105 | 1.90 | MIDDLE |
| 0–2 mm | | 70 | 30 | 263 | 1.95 | LIGHT END |
| 80 g | As in | | | 121 | 1.89 | HEAVY END |
| PARTICLES | Drawings | | | 144 | 1.91 | MIDDLE |
| 0.5–2 mm | | | | 340 | 1.90 | LIGHT END |
| 40 g | As in | | | 156 | 1.87 | HEAVY END |
| PARTICLES | Drawings | | | 135 | 1.88 | MIDDLE |
| 0.5–2 mm | | | | 262 | 1.87 | LIGHT END |
| 80 g | As in | 70 | 30 | 107 | 2.00 | HEAVY END |
| PARTICLES | Drawings | 80 | 20 | 257 | 2.00 | LIGHT END |
| 0–2 mm | | | | | | |
| 80 g | As in | 70 | 30 | 141 | 2.01 | HEAVY END |
| PARTICLES | Drawings | 75 | 25 | 311 | 2.07 | LIGHT END |
| 0.5–2 mm | | | | | | |

I claim:

1. A process for casting molten ferrous metal in a mould comprising providing a mould having a mould cavity and a runner system comprising a sprue, a sprue well and a runner, and having located in the runner a ceramic filter having an open-cell foam structure, locating in a chamber in the runner system on that side of the filter which is further from the mould cavity a sealed plastics container containing particles of a treatment agent for the molten ferrous metal such that part of the container is in the sprue well, and pouring the molten ferrous metal into the mould so that the molten ferrous metal is treated by the treatment agent before flowing through the filter and into the mould cavity.

2. A process according to claim 1 wherein the container is located in the chamber such that its top surface is above the top of the chamber.

3. A process according to claim 1 wherein at least part of a lateral surface and the adjacent part of the top surface of the container are in the sprue well.

4. A process according to claim 1 wherein the sprue well has an upper part and a lower part, the dimensions of the lower part transverse to the horizontal axis of the runner are smaller than those of the upper part, and only the central part of the lateral surface of the container below the height of the chamber is in contact with the lower part of the sprue well.

5. A process according to claim 1 wherein the area of the top surface of the container in the sprue well does not exceed 50% of the total area of that surface.

6. A process according to claim 1 wherein at least part of the runner between the ceramic filter and the container has a cross-sectional area equal to the smallest horizontal cross-sectional area of the sprue.

7. A process according to claim 1 wherein the treatment agent is an agent for inoculating grey cast iron or spheroidal graphite iron, an agent for converting graphite in molten iron to nodular or spheroidal form, an agent for converting graphite in molten iron to vermicular form, or an agent for introducing an alloying element into molten iron.

8. A process according to claim 1 wherein the treatment agent has a particle size of up to 10 mm.

9. A process according to claim 8 wherein the treatment agent has a particle size of up to 6 mm.

10. A process according to claim 9 wherein the treatment agent has a particle size of 0.5–2 mm.

11. A process according to claim 1 wherein the plastics forming the sealed container is polystyrene, polyproplylene, an acryloitril-butadiene-styrene polymer, a polyamide, polyethylene, or an ethylene-vinyl alcohol polymer.

12. A process according to claim 1 wherein the sealed plastics container is a parallelepiped.

13. A process according to claim 1 wherein the sealed plastics container is cylindrical.

14. A mould for casting ferrous metal comprising a mould cavity and a runner system comprising a sprue, a sprue well and a runner, said mould having located in the runner a ceramic filter having an open-cell structure, and located in a chamber in the runner system on that side of the filter which is further from the mould cavity a sealed plastics container containing particles of a treatment agent for the molten ferrous metal such that part of the container is in the sprue well.

* * * * *